US006107730A

United States Patent [19]

Park et al.

[11] Patent Number: 6,107,730

[45] Date of Patent: Aug. 22, 2000

[54] PROCESS FOR MANUFACTURING A FRAME FOR COLOR PICTURE TUBES

[75] Inventors: Jung-dae Park; Haeng-min Koo, both of Pusan-si, Rep. of Korea

[73] Assignee: Samsung Display Devices Co., Ltd., Suwon-si, Rep. of Korea

[21] Appl. No.: 09/101,965

[22] PCT Filed: Jan. 20, 1997

[86] PCT No.: PCT/KR97/00011

§ 371 Date: Jul. 20, 1998

§ 102(e) Date: Jul. 20, 1998

[87] PCT Pub. No.: WO97/26386

PCT Pub. Date: Jul. 24, 1997

[30] Foreign Application Priority Data

Jan. 19, 1996 [KR] Rep. of Korea ..... 96/1121

[51] Int. Cl.[7] ..... H01J 9/02

[52] U.S. Cl. ..... 313/408; 445/30

[58] Field of Search ..... 313/402, 408; 445/45, 30

[56] References Cited

U.S. PATENT DOCUMENTS

| | | | |
|---|---|---|---|
| 5,141,822 | 8/1992 | Matsuo et al. . | |
| 5,793,156 | 8/1998 | Han et al. | 313/408 |

FOREIGN PATENT DOCUMENTS

| | | |
|---|---|---|
| 230320 | 7/1987 | European Pat. Off. . |
| 0308563 | 3/1989 | European Pat. Off. . |
| 61-239941 | 10/1986 | Japan . |
| 64-001894 | 1/1989 | Japan . |
| 89152204 | 1/1989 | Japan . |
| 2173424 | 10/1986 | United Kingdom . |

*Primary Examiner*—Kenneth J. Ramsey
*Attorney, Agent, or Firm*—Christie, Parker & Hale, LLP

[57] ABSTRACT

The alloyzation reaction of steel and zinc is performed with only heat in calcinating, baking, sealing and exhausting of gas of a frame of a machine part for a color picture tube to form τ and δ phases and form a film of alloy. The film of alloy plays a role of the oxidized film to be capable of omitting the oxidizing process, and to prevent the corrosion and the oxidation to start before a thermal treatment, by the zinc layer.

5 Claims, 1 Drawing Sheet

PROCESS FOR MANUFACTURING A FRAME FOR COLOR PICTURE TUBES

BACKGROUND OF THE INVENTION

1. Field of the Invention

The present invention relates to a frame for a color picture tube, more specifically, to a frame for a color picture tube having an oxidized film formed thereon by plating zinc on a steel for a frame and calcinating, baking, sealing and exhausting of gas without an oxidizing process to overcome problems that occur by an oxidizing process and to manufacture by a simpler process.

2. Description of the Related Arts

After a shadow mask for color picture tubes (CPT) is assembled with a screen in a panel leaving a space between them, it is annealed for further processing and forming processes. The mask is finally formed by a press, and foreign substances such as oil, contaminants and fingerprints are removed by a next step, a degreasing process. The degreasing process is to remove oil and foreign substances used in the forming process by using original trichloroethylene solution. The formed shadow mask is fixed on a frame by welding to maintain the form thereof. For the frame to play a role of fixing the shadow mask, no changes of the form or outer size of the frame must be observed after calcinating for stability of an assembly against heat. The frame is assembled through springs which are attached by welding on the side faces of the frame. The frame and the degreased mask are electrically welded to produce a mask assembly and oxidized to prevent rust from forming. The oxidizing process is the process that forms an oxidized film of iron oxide ($Fe_30_4$) on the surface of the mask to protect from possible oxidation and diffused reflection such as thermal decalescence and exposure to light beams.

An oxidizing process is carried out according to the following oxidation reaction.

$$Fe + CO_2 \underset{\text{reduction}}{\overset{\text{oxidation}}{\rightleftharpoons}} FeO + CO \uparrow \qquad (1)$$

$$3FeO + CO_2 \longrightarrow Fe_3O_4 + CO$$

$$Fe + H_2O \longrightarrow FeO + H_2 \uparrow \qquad (2)$$

$$3FeO + H_2O \longrightarrow Fe_3O_4 + H_2$$

$$3Fe + 4CO_2 \longrightarrow Fe_3O_4 + 4CO \uparrow \qquad (3)$$

$$3Fe + 4H_2O \longrightarrow Fe_3O_4 + 4H_2$$

The oxidizing process proceeds by reactions (1) and (2) above 570° C. and by reaction (3) below 570° C. The steel used for such frames can form rust by oxidation before an oxidizing process, and an oxidized film produced with iron oxide ($Fe_30_4$ and FeO) is brittle and weak and clogs holes in the film. Therefore, the surface of the frame contains rust which can produce foreign materials before the oxidizing process and the total process is more complicated by an addition of an oxidizing process.

Japanese Patent 89-1522044 discloses a process for a color picture tube solving the above problem of the conventional arts. After Ni and Cr are plated on a shadowmask, frame and inner shield at a thickness of 0.5 $\mu$ to 1.0 $\mu$, the shadowmask and the frame are welded to produce a maskframe. The frame and a holder are attached, and the maskframe and a panel are assembled. Then the fluorescent screen is formed, and an oxidized film of metal components is formed using sealing, exhausting and aging processes. The surface of the metal formed by a thermal process and not an oxidizing process is thinner and harder than the conventional oxidized film.

SUMMARY OF THE INVENTION

Accordingly, the present invention is intended to overcome the above-described disadvantages of the conventional arts and to provide a process for making a frame for a color picture tube whereby corrosion and oxidation of steel break out before the frame undergoes an oxidizing process to prevent production of foreign materials and to replace an oxidizing process with a more simple process.

An embodiment of the present invention provides a process for making a frame for a color picture tube comprising plating zinc on steel, forming the steel into a frame using an oil, degreasing the oil, and calcinating, baking, sealing and exhausting gas. Preferably, a thermal process is used for calcinating, baking, sealing and exhausting gas to react alloyzation of the steel and zinc. Preferably, the zinc-plating is carried out electrically.

Another embodiment of the present invention is a color picture tube having a frame comprising $\tau$ and $\delta$ phases formed by alloyzation reaction of zinc and steel. The alloyzation reaction of zinc and steel is preferably carried out only by thermally calcinating, baking, sealing and exhausting gas without an oxidizing process.

BRIEF DESCRIPTION OF THE DRAWINGS

The above object and other advantages of the present invention will become more apparent by describing in detail the preferred attached drawings in which.

DETAILED DESCRIPTION OF THE EMBODIMENTS

Figure 1:
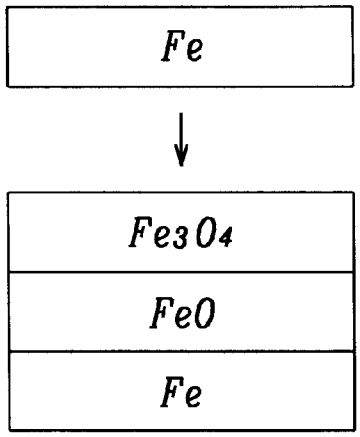
FIG. 1 is a cross section of the film produced by an oxidizing process of the frame according to the conventional process.
Figure 2:
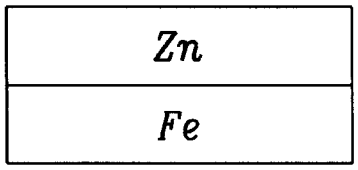
FIG. 2 is a cross section of a steel alloy according to an embodiment of the present invention.
Figure 3:
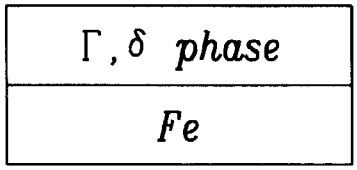
FIG. 3 is a cross section of a steel film for the frame according to an embodiment of the present invention.

Although the invention is described with reference to a preferred embodiment it is to be understood that the invention is not limited to the preferred embodiment as herein described.

EXAMPLE

A cold rolled steel sheet was electrically plated with zinc. The steel sheet was mold-processed in the press by calcinating, baking, sealing and exhausting in nitrogen air to produce a fixed a frame for a color picture tube.

COMPARATIVE EXAMPLE

A cold rolled steel sheet was oxidized at high temperature in methane gas and air atmosphere and was calcinated, baked, sealed, exhausted of gas and mold-processed in the press to produce a frame for a color picture tube with fixed size.

According to the present invention, the alloyzation reaction of the zinc occurs with only heat in calcinating, baking, sealing and exhausting of gas in a nitrogen gas atmosphere without an oxidizing process. The film of an alloy was formed by the formation of τ and δ phases. Therefore, the present invention prevents the production of foreign substances from the rust on the frame before an oxidizing process and the clogging of holes by parts of the oxidized film. The omission of an oxidizing process brings about an economical effect.

What is claimed is:

1. A process for making a frame for a color picture tube comprising the steps of:

plating zinc on steel;

forming the steel into a frame using an oil;

degreasing said oil; and calcinating, baking, sealing and exhausting of gas.

2. The process for making a frame for a color picture tube according to claim 1, wherein a thermal process of said calcinating, baking, sealing and exhausting of gas is carried out to react alloyzation of said steel and said zinc.

3. The process for making a frame for a color picture tube according to claim 1, wherein said plating is performed electrically.

4. A color picture tube comprising a frame having τ and δ phases formed by an alloyzation reaction of zinc and steel.

5. The color picture tube according to claim 4, wherein said alloyzation reaction of zinc and steel is performed with only heat in calcinating, baking, sealing and exhausting of gas without a oxidizing process.

* * * * *